US005515064A

United States Patent [19]

Bacnik et al.

[11] Patent Number: 5,515,064

[45] Date of Patent: May 7, 1996

[54] MOBILE COMMUNICATIONS ANTENNA ASSEMBLY

[75] Inventors: James A. Bacnik, Mentor; James Hadzoglou, Mayfield Heights, both of Ohio

[73] Assignee: Allen Telecom Group, Inc., Solon, Ohio

[21] Appl. No.: 83,054

[22] Filed: Jun. 25, 1993

[51] Int. Cl.[6] ..... H01Q 1/32; H01Q 1/50

[52] U.S. Cl. ..... 343/860; 343/715

[58] Field of Search ..... 343/715, 873, 343/713, 860; 11/1; H01Q 1/32, 1/50

[56] References Cited

U.S. PATENT DOCUMENTS

| | | | |
|---|---|---|---|
| 4,709,240 | 11/1987 | Bordenave | 343/873 |
| 4,785,305 | 11/1988 | Shyu | 343/715 |
| 4,825,217 | 4/1989 | Choi | 343/715 |
| 4,839,660 | 6/1989 | Hadzoglou | 343/715 |
| 4,882,592 | 11/1989 | Studer et al. | 343/715 |
| 4,893,130 | 1/1990 | Metivier | 343/715 |
| 4,916,456 | 4/1990 | Shyu | 343/715 |
| 4,931,805 | 6/1990 | Fisher | 343/715 |
| 4,931,806 | 6/1990 | Wunderlich | 343/715 |
| 5,032,846 | 7/1991 | Chang | 343/882 |
| 5,099,251 | 3/1992 | Fisher | 343/715 |
| 5,283,589 | 2/1994 | Blevins | 343/713 |
| 5,343,214 | 8/1994 | Hadzoglou | 343/850 |

FOREIGN PATENT DOCUMENTS

| | | |
|---|---|---|
| 0506451 | 9/1992 | European Pat. Off. . |
| 0521746 | 1/1993 | European Pat. Off. . |
| 2218852 | 11/1989 | United Kingdom . |

*Primary Examiner*—Michael C. Wimer

*Attorney, Agent, or Firm*—Dressler, Goldsmith, Shore & Milnamow, Ltd.

[57] ABSTRACT

A window mounted antenna system having a foot or exterior support member attached to an antenna radiator or whip and typically mounted on the outside of a window or dielectric member comprised of a plastic decorative housing, a conductive foot portion which acts as the coupling capacitor and is inserted into the cover and conductively connected to the radiating member or whip, and a fastener for attaching the whip to the foot or base portion. The conductive foot includes attachment fingers insertable into the housing and retained in place upon insertion therein, and one or more flanges for receiving a fastener passed through the end of the antenna. A coupling assembly disposed on the other side of the window includes a formed or stamped conductive element which incorporates the various conductive components which make up the coupling assembly. The conductive components are overmolded with a nonconductive support material to produce an integrated structure incorporating the various components of the coupling assembly.

17 Claims, 2 Drawing Sheets

FIG. 1
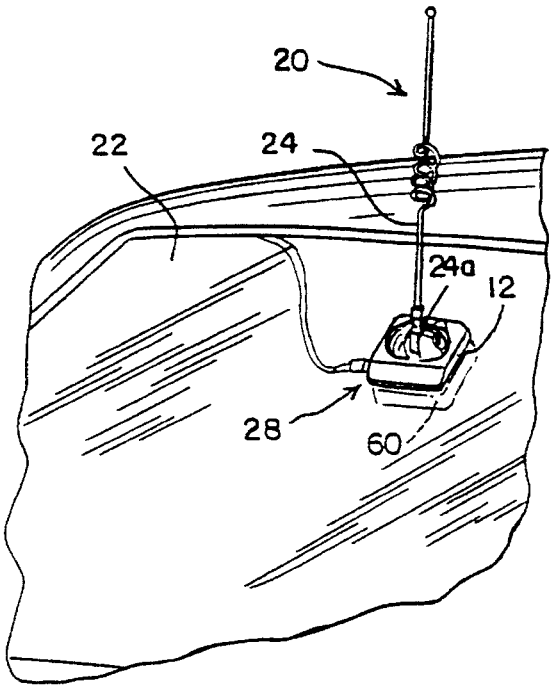
FIG. 2
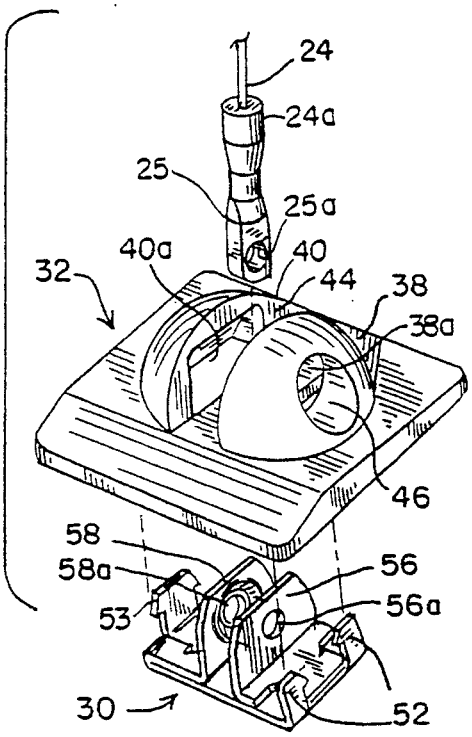
FIG. 3
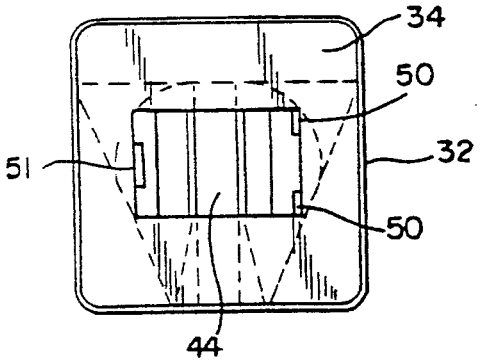
FIG. 6
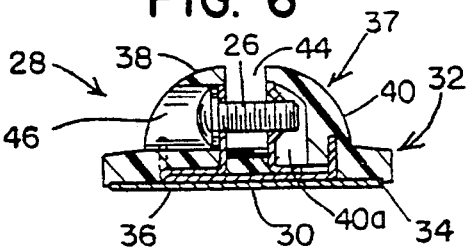
FIG. 4
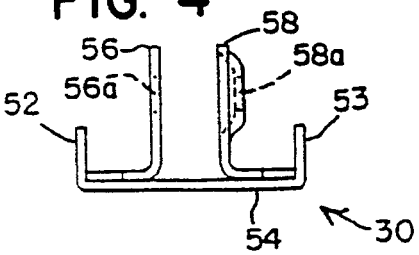
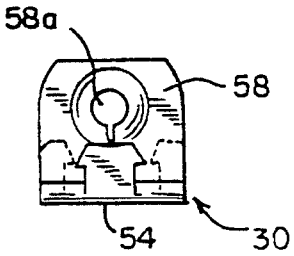
FIG. 5

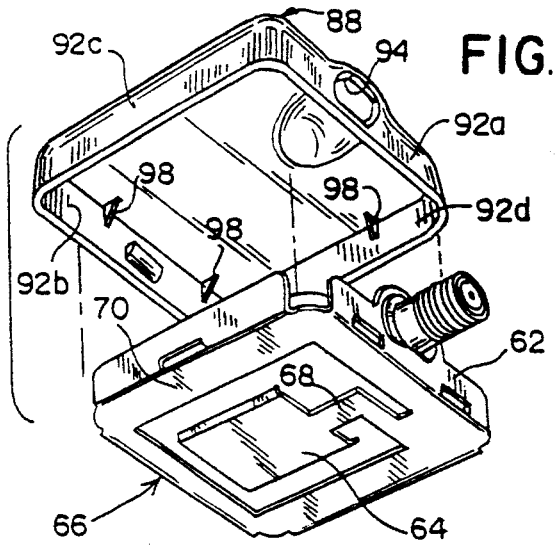
FIG. 7
FIG. 8
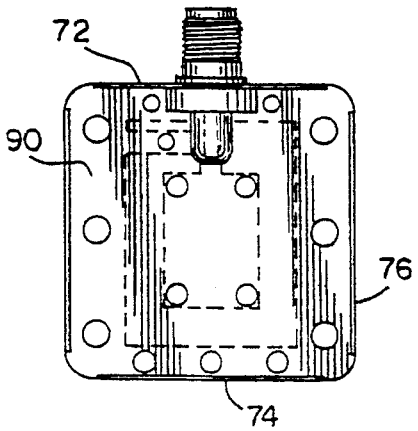
FIG. 9
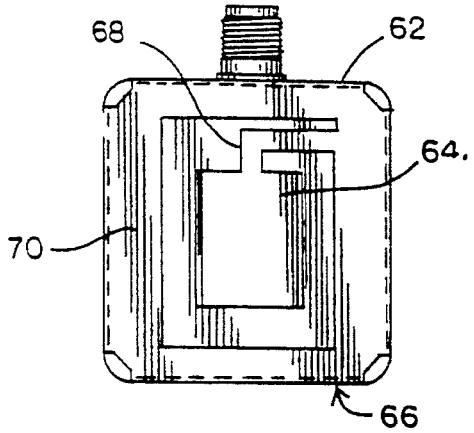
FIG. 10
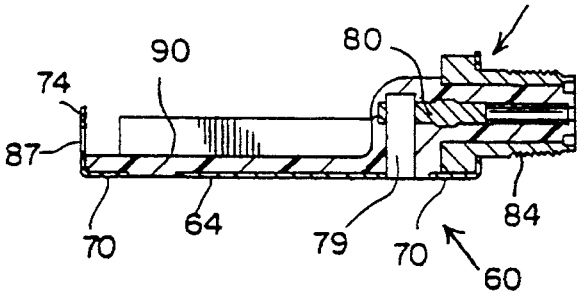
FIG. 11
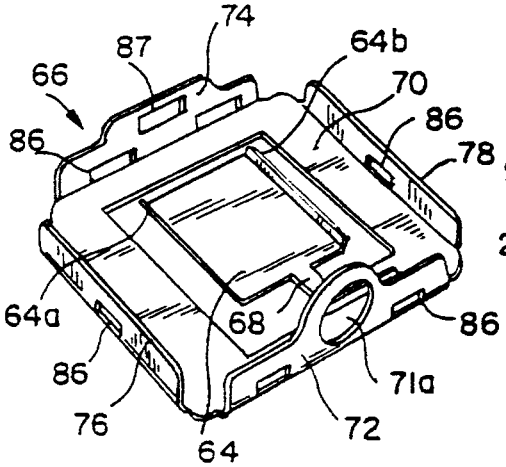
FIG. 12
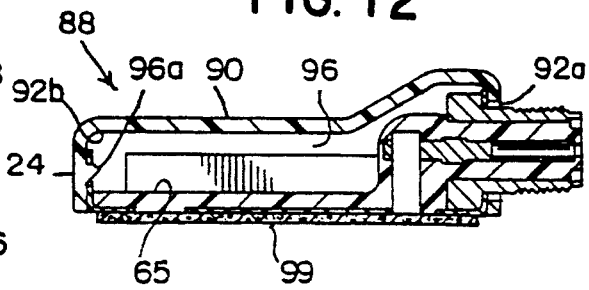

MOBILE COMMUNICATIONS ANTENNA ASSEMBLY

FIELD OF THE INVENTION

The present invention relates to communication antennas and more particularly to mobile communication antennas of the type adapted to be mounted on a nonconductive surface such as, for example, glass in the form of a vehicle window, particularly those antennas intended for use in the UHF frequency bands typically at frequencies in excess of 800 Mhz.

BACKGROUND OF THE INVENTION

The growth and popularity of cellular telephone communications and other related personal mobile communications has been accompanied by a similar growth of antennas mountable on vehicles without damaging the vehicle. Window mounted antennas are typical of such antennas, particularly for communications devices in private vehicles.

Such antenna assemblies include a radiating member, typically an elongated whip, an external support base or foot connected to the radiating member and attached or mounted on the outside surface of a non-conductive dielectric member, such as a window, and internal coupling circuitry attached or mounted to the inside surface of the nonconductive dielectric member juxtaposed with the outer foot or antenna support base. The communications signal is coupled between the radiating member and antenna foot on one side of the window, e.g., outside a vehicle, and the coupler system connected to a transceiver located on the other side of the window, e.g., inside a vehicle.

UHF antennas of the type disclosed and claimed in Hadzoglou U.S. Pat. No. 4,839,660, have been sold worldwide. It would be desirable to simplify the construction and configuration of such antennas without adversely affecting their performance. The goals of reducing costs of antennas while maintaining their performance and the quality of their construction and avoiding other performance pitfalls requires continuing simplification and alternative construction techniques. The desirability of such modifications and the cost savings to the manufacturer and ultimately to the consumer are evident. It is important to guard against deterioration of performance characteristics of the antennas when attempting to reduce costs.

SUMMARY OF THE INVENTION

In accordance with the present invention, there is provided a window mounted antenna system capable of automated manufacture with a minimum of components to facilitate and maintain or improve reliability and avoid deterioration of performance while hopefully resulting in reduced costs.

In accordance with the present invention, the base or exterior support member attached to the antenna whip and typically mounted on the outside of a window or dielectric member is basically reduced to four components, a plastic decorative cover, a conductive foot portion which is conductively connected to the radiating member or whip and acts as one plate of a coupling capacitor, a fastener for attaching the whip to the foot or base portion, and an adhesive or other material used to attach the foot or support member to the window.

The base incorporating the present invention can utilize a molded decorative plastic cover and a conductive insert which acts as the conductive foot. The conductive foot includes attachment fingers or projections which are inserted into the cover and are engageable therewith to be retained in place therein. The metallic foot is also formed with one or more flanges for receiving a fastener passed through the end of the radiating member or whip. One of the flanges can be adapted to threadably engage a fastener to eliminate the necessity of using additional components, such as nuts. The flanges may be flexible to aid in retention of the antenna whip at a selected angular position relative to the base upon tightening of the fastener. This flexibility and the resulting spring tension as the fastener is tightened simulates the function of, and eliminates the need for, lock washers.

The coupling assembly includes a stamped conductive element which incorporates the various conductive components which make up the coupling assembly. These include a coupling capacitor plate for coupling to the exterior foot through the window on which it is mounted, the conductive connections to the plate, and a conductive counterpoise portion surrounding the coupling plate and typically including peripheral portions oriented in the same plane as the plate and in planes transverse thereto. Components of a connector, such as a coaxial connector for coupling to a transmission line connected to the transceiver, are connected to the conductive element.

The conductive components are overmolded with a nonconductive material to produce an integrated rigid structure incorporating the various components of the coupling assembly.

The coaxial connector can be a complete connector or can be formed in place during the production of the coupling assembly. If formed in place, a connector bushing is attached to an upstanding wall of the conductive stamping and a connector pin defining the center contact of the connector is electrically connected to a projecting stub extending upwardly from the plane of the coupling plate portion of the metallic stamping. The overmolding of the plastic fixes the various components in place one relative to the other. If a cover is used, it is inserted over the electrical components and snapped in place. The coupling system incorporating the present invention permits automated production and assembly of the various components.

An antenna assembly utilizing simplified components made in accordance with the present invention retains its performance characteristics. The continued wide band impedance matching characteristics permit use of such antennas in services such as a wide band cellular telephone and other services which utilize a broad band of frequencies particularly in the 800+ Mhz range. The use of a single (one-piece) element for the metallic components in the form of a stamping controls the amount of material, the shape and size of the various components, including the counterpoise, as necessary for the particular frequency range in which the unit is to be used while permitting rapid and automatic manufacture and minimizing the assembly steps, without adversely affecting performance.

Numerous other features and advantages of the present invention will become readily apparent from the following detailed description of the invention and an embodiment thereof, from the claims, and from the accompanying drawings in which the details of the invention are fully and completely disclosed as a part of this specification.

BRIEF DESCRIPTION OF THE DRAWINGS

FIG. 1 is a perspective view of an antenna assembly incorporating the present invention;

FIG. 2 is an exploded perspective view of the support member or base for the antenna assembly incorporating the present invention showing a portion of the whip;

FIG. 3 is a bottom view of the cover of FIG. 2;

FIG. 4 is a side elevational view of the conductive foot forming part of the base for the antenna assembly incorporating the present invention;

FIG. 5 is an end elevational view of the conductive foot of FIG. 4;

FIG. 6 is a sectional view of the base with the foot installed in the cover;

FIG. 7 is an exploded perspective view of the coupling assembly for the antenna assembly incorporating the present invention with a cover;

FIG. 8 is a top plan view of the coupling assembly of FIG. 7 without a cover;

FIG. 9 is a bottom plan view of the coupling assembly of FIG. 7;

FIG. 10 is a sectional view taken along line 10—10 of FIG. 8;

FIG. 11 is a perspective view of the single conductive member forming part of the coupling assembly; and FIG. 12 is a sectional view, similar to FIG. 10, showing the cover in place.

DETAILED DESCRIPTION OF PREFERRED EMBODIMENT

While this invention is susceptible of embodiment in many different forms, there is shown in the drawing and will be described herein in detail a specific embodiment thereof with the understanding that the present disclosure is to be considered as an exemplification of the principles of the invention and is not intended to limit the invention to the specific embodiment illustrated.

Referring to the drawings, there is disclosed an antenna assembly 20 attachable to a dielectric member 22 such as the window of a vehicle. The antenna assembly 20 includes a radiating member in the form of an elongated whip 24. The lower end of the whip 24 includes a suitable adapter **24*a* conductively connected to the whip. The adapter 24*a* is threaded for removable attachment to a threaded mounting member 25 which includes an aperture 25*a* therein for receiving a suitable fastener 26 for attachment of the whip 24 to a support base 28 which includes a conductive foot 30. The base 28 is mounted on or otherwise suitably attached to one surface of the dielectric member 22**, e.g., the outer surface of a vehicle window.

The base 28 also includes a nonconductive cover or body 32 typically molded from a suitable plastic material such as a polyurethane. The nonconductive cover 32 includes a generally planar flat bottom having a flat planar surface 34 to which is attached an appropriate adhesive pad 36 for mounting and attaching the base 28 to the surface of the dielectric member 22. The cover 32 includes a raised portion 37 in the form of a pair of ears 38, 40 which extend up from and are formed integrally with the top portion of the cover 32. The ears 38, 40 are configured to provide a smooth decorative appearance and are undercut to define cavities **38*a*, 40*a*, respectively, within each of the ears 38, 40**.

The ears 38, 40 of raised portion 37 are separated by a slot or gap 44 which is adapted to receive one end of the antenna whip 24, more particularly the mounting member 25 attached to the adapter **24*a*. The mounting member 25 extends through the slot 44 to a position in which the aperture 25*a* is aligned with a transverse bore 46 formed in at least one of the ears 38. The bore 46 is adapted to receive the threaded fastener 26, which may be a self tapping screw. The fastener 26 passes through the bore 46 in the ear 38 and through the aperture 25*a* formed in the mounting member 25 forming the end of the whip 24 for attaching the whip to the conductive foot 30**.

The bottom surface 34 of the nonconductive cover 32 includes a generally rectangular opening 48 formed therein which communicates with the cavities **38*a*, 40*a* forming the hollow interior within the raised portion 37. One or more strengthening ribs 49 extend across the opening to improve the rigidity of the cover. A plurality of apertures or channels 50, 51 oriented transverse to the plane of the bottom surface 34 are located adjacent the periphery of the opening 48. The channels 50 are located at or adjacent to the corners of opening 48 and extend into the body of the ear 38. The channel 51 is located at or adjacent to the center of the opposite side of opening 48 from channels 50 and extends into the body of the ear 40. The channels 50, 51 are adapted to engage and retain therein barbed fastening projections 52, 53, respectively, formed as part of the conductive foot 30. The use of a different arrangement of barbed fastening projections is intended to insure proper orientation of the foot 30 when inserted into the cover 32**, as discussed below.

The conductive foot 30 includes a flat plate portion 54 which acts as a coupling member and which fits into the opening 48 formed in the bottom surface 34 of the nonconductive cover 32. The projections 52, 53 with peripheral barbs extend transverse to the plane of the flat portion 54 and are inserted into the channels 50, 51 formed in the nonconductive cover 32. The barbs at the free ends of each of the projections 52, 53 engage the walls of the channels 50, 51 to retain the conductive foot 30 in place and against removal when inserted into the nonconductive cover 32.

The conductive foot 30 incorporates a pair of upright conductive resilient flanges 56, 58. Flange 56 extends into the cavity **38*a* formed in ear 38 and flange 58 extends into the cavity 40*a* formed in ear 40 when the foot 30 is attached to the cover 32. The resilient flanges 56, 58 include aperture 56*a*, 58*a*, respectively. The apertures 56*a*, 58*a* are aligned with the bore 46 formed in the ear 38 when the nonconductive cover 32 and the conductive foot 30** are assembled.

The flanges 56, 58 are disposed on either side of the slot 44 formed in the raised portion 37 and are thus positioned on opposite sides of the connecting member 25 forming the end of the radiating member or whip 24 when inserted through the slot 44 into the open area formed by the cavities **38*a*, 40*a* within the raised portion 37 of the nonconductive cover 32. The fastener 26 passes through the bore 46 in ear 38 through the aperture 56*a* formed in the conductive flange 56, through the aperture 25*a* formed in the whip mounting member 25 to threadably engage the aperture 58*a* formed in the other conductive flange 58**.

Conductive flange 58 and aperture **58*a* define a coarse helical pitch which acts as a thread for engagement with the fastener 26. Use of a coarse pitch fastener, such as a self threading screw, results increasing applied torque and makes use of a nut and lock washer unnecessary. The resilience of the flanges 56, 58** results in a spring like tension as the fastener is tightened which simulates the function of a lock washer.

The arrangement of the projections 52, 53 and the channels 50, 51 are intended to insure proper orientation of the foot with the flange 56 being positioned in cavity **38*a* and flange 58 being positioned in cavity 40***a*. The two flanges 56, 58 can be flexed and are tightened against the surface of the mounting member 25 forming the end of whip 24 to retain the whip in a selected angular position relative to the base 28 when attached thereto.

A coupling assembly 60 is mounted on or otherwise suitably attached to the opposite surface of the dielectric member 22 from the support base 28, e.g., on the inner surface of a vehicle window, and is juxtaposed therewith. The function of the coupling system is to couple signals between the antenna connected to the foot on the outside of the window and a transceiver located on the inside of the window and coupled to the coupling system 60, e.g., by a coaxial cable connected therebetween.

The primary conductive component of the coupling system 60 is a stamped metallic member 62, typically made of brass, which includes a central planar portion 64 having angled extensions 64*a*, 64*b* to improve mechanical interconnection with a molded plastic body 65. The central planar portion 64 forms the coupling member and interacts with the foot coupling member 54 and dielectric member 22 to define a coupling capacitor. The stamped metallic member 62 also includes a surrounding counterpoise portion 66 and electrical connection portion 68 extending between the coupling member 64 and the counterpoise 66.

The counterpoise portion 66, which is in the form of a closed loop surrounding coupling capacitor plate 64, incorporates a peripheral planar portion 70 lying in the plane of the coupling capacitor plate 64. The outer edges of the counterpoise 66 are formed transverse to the plane of the peripheral portion 70 to define a pair of end walls 72, 74 and a pair of side walls 76, 78. The planar portion 66 and the walls 72, 74, 76, 78 define the counterpoise 66 for the antenna assembly 20.

The centrally located coupling member or plate 64 is disposed within the counterpoise 66 and is connected thereto by the conductive connection portion 68. The stamped metallic member 62 also includes a vertical projection or connection stub 79 which extends upwardly from a point intermediate the ends of the conductive connection portion 68. The location of connection stub 79 is selected for proper impedance matching.

The connection stub 79 is electrically connected to a female center connector component 80 which is used to form the center conductor of a coaxial connector 82. The outer connector or barrel 84 of the connector 82 is mechanically and electrically connected to the counterpoise 66 of the stamped metallic member 62 in an opening 72*a* formed in the end wall 72.

A plurality of slots 86 are formed in each of the counterpoise walls 72, 74, 76, 78 adjacent the intersection thereof with the planar portion 70 to improve the bond between the metallic member 62 and the plastic body 65. An additional slot 87 is formed in end wall 74 for use in connecting the assembled components to a coupling assembly cover 88.

The assembled components including the stamped conductive member 62, the connector center conductor 80 affixed to the stub 79 and a portion of the connector barrel 84 are overmolded, such as by injection molding, with a suitable material which fills in the gaps and forms a molded body 65 to provide sufficient rigidity and strength to produce a relatively rigid structure. The molded plastic body 65 adheres to the metal stamping 62, enters slots 86, surrounds the extensions 64*a*, 64*b* and center conductor 80 of the coaxial connector 82 and passes through the annular opening between the center conductor 80 and the barrel 84 to effectively form the coaxial connector 82 in place.

The cover 88 is positioned over the assembled components to complete the coupling assembly. The cover 88 has a top 90 and four depending walls 92*a*, 92*b*, 92*c*, 92*d* which overlie the walls of the stamping. As shown in the drawing, one wall 92*a* of the cover is provided with an opening 94 through which the coaxial connector 82 is passed. The connector 82 is inserted through the opening 95 in the cover 88 which is pressed over the outside of the conductive walls 72, 74, 76, 78 of the counterpoise portion 66. The cover 88 includes a projection 96 on wall 92*b* which engages the additional slot 87 formed in the end wall 74 of the counterpoise 66 for retaining the cover 88 in place. A plurality of crush ribs 98 engage the edge of the conductive walls 72, 74, 76, 78 of the counterpoise portion 66 to hold the cover 88 tightly in place. The crush ribs 98 are sufficiently thin to give way as they engage the upper edges of the walls 72, 74, 76, 78, but are intended to remain in contact therewith to help retain the components against relative movement. An appropriate adhesive pad 99 is attached to the bottom surface of the coupling assembly 60 for mounting and attaching the assembly 60 to the surface of the dielectric member 22.

Thus, there has been disclosed a simplified construction of an antenna assembly adapted for mounting on a dielectric member. The base for supporting the whip on one side of the dielectric member is constructed simply of two primary components and a fastener together with an adhesive pad for attaching the base to the window or dielectric member. The coupling system disposed on the opposite side of the dielectric member and juxtaposed with the base is formed of a conductive stamping configured to incorporate the various conductive components required of the coupling system including a coupling plate, the conductive counterpoise, which includes a portion that lies in the plane of the coupling capacitor plate, and peripheral portions transverse thereto, with the connective members forming apart of the coupling system.

The components of a connector are suitably attached to the stamping either mechanically and electrically, and the entire assembly is unitized by molding a support body thereto which encloses the various conductive components, forms the coaxial connector in place, limits exposure of the welded components to the environment, and provides structural integrity for the coupling system. A nonconductive cover encloses the components of the coupling system and is attached thereto.

The components of the antenna system incorporating the invention are simply and easily produced, and can be assembled on a production and automated basis.

The operating characteristics of an antenna such as disclosed and claimed in the present application correspond to the characteristics of more complicated and expensive configurations while permitting improved manufacturing techniques for reducing manufacturing costs.

An antenna incorporating the present invention designed to operate in the UHF frequency bands, typically at frequencies in excess of 800 Mhz such as the cellular band which in the United States is about 824 Mhz to 896 Mhz, has a rectangular exterior coupling plate having a dimension of about 0.992 inch by about 0.669 inch. The spacing between the center projections engageable with the antenna whip is about 0.255 inch. Each of the flanges is located about 0.369 inch from the peripheral edge of the coupling plate. The peripheral projections and barb extend upwardly about 0.25 inch and are engageable in the plastic body for retaining the conductive coupling member in place.

In the coupling system, the overall dimension of the conductive stamping is about 1.66 inches square. The corners are typically removed, and each of the upwardly projecting peripheral walls of the counterpoise are about 1.343 inches in length and about 0.275 inches in height. The width of the peripheral portions of the counterpoise at the opposite ends of the stamping are each about 0.227 inches. The width or thickness of the peripheral portions extending along the sides are about 0.35 inch.

The center coupling plate has a dimension of about 0.67 inch by about 0.70 inch, including the angled extensions. The conductive connection between the center plate and the peripheral counterpoise extends from the center of one of the narrow sides and is about 0.125 inch in width. It projects approximately 0.249 inches out from the short side and then turns at a 90° angle and extends to and merges with the inner peripheral edge of the counterpoise. It is spaced away from the other peripheral side by a distance of about 0.63 inch. The stub which is soldered to the center conductor extends up a distance of about 0.36 inches and is soldered to an extension of the coaxial center conductor as described above.

An antenna incorporating the dimensions when used for cellular communications in the frequency band described above is capable of exhibiting a VSWR of 1.5:1 or less over a bandwidth of about 70 MHz. In addition, the antenna system exhibited a generally omni-directional radiation pattern with relative field strengths typically greater than those produced by a roof mounted quarter-wave antenna with the same input power.

Laboratory measurements suggest that the configuration of the coupling system incorporating the present invention is capable of limiting surface currents on the coax feed line to low levels, e.g., on the order of 20 db below the maximum current on the external whip. Such low currents on the cable are desirable to minimize interference with sensitive electronic components utilized in vehicles on which the antenna assembly of the present are mounted. Similarly, surface currents on the coaxial cable may be capable of picking up interference generated by such microprocessors, resulting in "noise" during use of communications devices connected thereto.

While the above dimensions are illustrative of one embodiment of the antenna incorporating the present invention, it is recognized that dimensional variations are possible, and other dimensions may be suitable for an antenna operating at the same frequency range as well as for antennas operating at other frequency bands.

The material which is utilized to overmold the coupling components is a natural polyphenylene oxide. One such material is virgin LNPZF1004, available from LNP Engineering Plastics, Inc., of Exton Pa., selected for its electrical and mechanical properties. These properties include a dielectric constant of about 2.92 and a dissipation factor of 0.0015 at 1MHz, and a mold shrinkage on the order of 0.001–0.004 in./in. Alternative materials exhibiting similar properties may also be used.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the appended claims.

What is claimed is:

1. An antenna system usable to radiate and receive radio frequency energy generated by and received by a transceiver at frequencies in the UHF frequency range and adapted for use with and attachment to a dielectric member, comprising:

a radiating member;

a support member attached to one end of said radiating member and mountable on one surface of the dielectric member; and a coupling system mountable on a second surface of the dielectric member in juxtaposition with said support member and connectable to the transceiver for coupling said radio frequency energy through the dielectric member between the transceiver and said radiating member;

said support member including a non-conductive body portion and a conductive coupling member:

said non-conductive body portion having a first side positionable adjacent said one surface of the dielectric member, said body portion defining an opening formed therein through said first side thereof, a raised portion on a second side thereof and a gap in said raised portion permitting passage therethrough of said one end of said radiating member, and a bore passing through at least a portion of said raised portion, said bore intersecting said one end of said radiating member passing through said gap for receiving a fastener engageable with said one end of said radiating member for fastening said radiating member to said support member;

said conductive coupling member having a generally planar portion received in said opening formed in said non-conductive body portion, a plurality of fastening projections insertable into said non-conductive body portion for retaining said conductive coupling member in place with said generally planar portion thereof co-planar with the surface of said first side of said non-conductive body portion, and at least one projecting flange portion oriented transverse to the plane of said generally planar portion and extending through said opening into the raised portion of said non-conductive body portion and intersecting said bore for receiving the fastener passing through said bore and said one end of said radiating member to fasten said radiating member to said support member with said radiating member thereby being firmly connected to said conductive coupling member.

2. An antenna system as claimed in claim 1 wherein said conductive coupling member is press fit into said non-conductive body portion.

3. An antenna system as claimed in claim 2 wherein said fastening projections of said conductive coupling member are disposed transverse to the plane of said planar portion and include barbs at the free ends thereof engageable with said non-conductive body portion for retaining said conductive coupling member against removal therefrom.

4. An antenna system as claimed in claim 3 wherein said non-conductive body portion includes a plurality of channels located adjacent the periphery of said opening and extending into said raised portion for receiving said fastening projections of said conductive coupling member.

5. An antenna system as claimed in claim 1 wherein said fastener is a threaded fastener and said projecting flange portion of said conductive coupling member includes a threaded opening engageable with said fastener passing through said one end of said radiating member for connecting said radiating member to said conductive coupling member and thereby to said support member.

6. An antenna system as claimed in claim 5 wherein said projecting flange portion of said conductive coupling member includes a pair of flanges disposed on opposite sides of said one end of said radiating member for retaining said radiating member therebetween, one of said pair of flanges being adapted to engage said fastener, said fastener passing through said bore, the other of said flanges, said radiating member and into said one flange and operable to tighten said flanges against said one end of said radiating member to retain said radiating member at a selected angular position relative to said support member.

7. An antenna system usable to radiate and receive radio frequency energy generated by and received by a transceiver at frequencies in the UHF frequency range and adapted for use with and attachment to a dielectric member, comprising:

a radiating member;

a support member attached to one end of said radiating member and mountable on one surface of the dielectric member; and a coupling system mountable on a second surface of the dielectric member in juxtaposition with said support member and connectable to the transceiver for coupling said radio frequency energy through the dielectric member between the transceiver and said radiating member;

said coupling system consisting of three elements, a one-piece electrically conductive member of fixed shape, an external electrically conductive connector, and an electrically non-conductive body;

said one-piece conductive member comprised of a first generally planar central conductive portion defining a coupling plate, a second generally planar closed loop conductive portion surrounding said central portion and defining a counterpoise for said antenna system, a third intermediate conductive portion interconnecting said first central conductive coupling plate portion and said second closed loop conductive counterpoise portion, and a fourth conductive connection stub portion oriented transverse to the plane of said first central conductive coupling plate portion for connection to said external connector;

said first central conductive coupling plate portion, said third intermediate conductive portion and at least part of said second closed loop conductive counterpoise portion lying in a common plane, said second closed loop conductive counterpoise portion including a conductive peripheral portion oriented transverse to said common plane;

said conductive connector having an annular body portion electrically connected to said conductive peripheral portion of said second closed loop conductive counterpoise portion and a center conductor disposed within said annular body portion and electrically connected to said fourth conductive connection stub portion; and said non-conductive body being associated with and covering a substantial portion of the inner surface of said fixed shape one-piece conductive member including substantially covering said fourth conductive connection stub portion, a major portion of said center conductor of said connector, and a major portion of the inner surfaces of said connector annular body portion.

8. An antenna system as claimed in claim 7 wherein said non-conductive body is molded to said one-piece fixed shape conductive member.

9. An antenna system as claimed in claim 8 wherein said non-conductive body is molded from natural polyphenylene oxide.

10. An antenna system as claimed in claim 7 wherein a portion of said non-conductive body is disposed between said first central conductive coupling plate portion and said second closed loop conductive counterpoise portion of said one-piece conductive member with the lower surface of said non-conductive body lying in said common plane.

11. An antenna system as claimed in claim 7 wherein said second generally planar closed loop conductive counterpoise portion and said first central conductive coupling plate portion are generally rectangular in shape.

12. An antenna system as claimed in claim 11 wherein said second rectangular closed loop conductive counterpoise portion is formed by four interconnected legs, with each of said legs having a first portion lying in said common plane and a second outer portion extending transverse to said common plane from the outer peripheral edge of said first portion, said second outer portions forming said conductive peripheral portion oriented transverse to said common plane.

13. An antenna system as claimed in claim 12 including a plurality of apertures formed in said transverse conductive peripheral portion, and wherein said non-conductive body is formed with projections passing through said apertures for maintaining the relative positions of said non-conductive body and said one-piece conductive member.

14. An antenna system as claimed in claim 7 including a cover for said coupling system.

15. An antenna system as claimed in claim 14 wherein said cover includes an expansive top surface and a plurality of depending walls, and wherein one of said depending walls includes an opening therein, said connector body portion passing through said opening when said cover is attached to said coupling system.

16. An antenna system as claimed in claim 15 wherein at least one of said depending walls of said cover is formed with a projection thereon, and said one-piece conductive member includes an opening therein positioned to engage said projection when said cover is attached to said coupling system for retaining said cover in place.

17. An antenna system as claimed in claim 7 wherein said said fourth conductive connection stub portion is electrically connected to and extends from said third intermediate conductive portion in a plane transverse to the plane of said first central conductive coupling plate portion.

* * * * *